US007975583B2

(12) United States Patent
Schmid

(10) Patent No.: US 7,975,583 B2
(45) Date of Patent: Jul. 12, 2011

(54) METHOD AND APPARATUS FOR THE AUTOMATIC TRIMMING OF PRINTED PRODUCTS

(75) Inventor: Christian Schmid, Zofingen (CH)

(73) Assignee: Mueller Martini Holding AG, Hergiswil (CH)

( * ) Notice: Subject to any disclaimer, the term of this patent is extended or adjusted under 35 U.S.C. 154(b) by 130 days.

(21) Appl. No.: 11/714,134

(22) Filed: Mar. 6, 2007

(65) Prior Publication Data

US 2007/0209492 A1 Sep. 13, 2007

(30) Foreign Application Priority Data

Mar. 9, 2006 (EP) ..... 06405104

(51) Int. Cl.
*B26D 7/01* (2006.01)

(52) U.S. Cl. ..... 83/241; 83/363; 83/403.1; 83/934

(58) Field of Classification Search ..... 83/363, 83/367, 403.1, 934, 241
See application file for complete search history.

(56) References Cited

U.S. PATENT DOCUMENTS 3,811,350 A * 5/1974 Marciniak ..... 83/39
RE28,840 E * 6/1976 Sarring ..... 83/63
4,922,773 A * 5/1990 Ito ..... 83/76.6
5,199,341 A * 4/1993 Jones ..... 83/100
6,536,319 B1 * 3/2003 Boss ..... 83/247
6,691,024 B2 2/2004 Kunz
6,796,209 B2 * 9/2004 Boss ..... 83/365

FOREIGN PATENT DOCUMENTS

EP 0 740 983 A1 11/1996
EP 1 152 310 A1 11/2001
EP 1 166 977 A1 1/2002
WO WO 91/16181 10/1991

OTHER PUBLICATIONS

European Search Report dated Aug. 24, 2006.

* cited by examiner

*Primary Examiner* — Kenneth E. Peterson
(74) *Attorney, Agent, or Firm* — Venable LLP; Robert Kinberg; Leigh D. Thelen

(57) ABSTRACT

A method and apparatus are provided for automatically trimming a plurality of printed products in a trimming apparatus having at least one trimming station including at least one blade positioned on a moveable yoke. The plurality of printed products are supplied successively through a feeding conveyor to the trimming station. Each of the plurality of printed products is transported within the trimming station via a trimming transport device to a predetermined position for trimming. The phase position of the feeding conveyor is adjusted relative to the moveable yoke for each of the plurality of printed products according to the format width of the printed product extending in a conveying direction.

9 Claims, 3 Drawing Sheets

METHOD AND APPARATUS FOR THE AUTOMATIC TRIMMING OF PRINTED PRODUCTS

CROSS-REFERENCE TO RELATED APPLICATION

This application claims the priority of European Patent Application No. 06405104.8, filed on Mar. 9, 2006, the subject matter of which is incorporated herein by reference.

BACKGROUND OF THE INVENTION

1. Field of Invention

The invention relates generally to printing products and more particularly to a method and apparatus for automatic trimming of printed products, such as brochures, magazines, catalogues, and book blocks.

2. Description of the Related Art

Conventional apparatuses for automatic trimming of printed products, such as brochures, magazines, catalogues, and book blocks, are provided with a trimming station including one or more blades positioned on a vertically moving yoke. The printed products are supplied successively from a feeding conveyor to the trimming station, where the printed products are trimmed on the edges by one or more blades.

One such conventional trimming apparatus, disclosed in document European Patent document EP 1 166 977 A1, is a so-called three-side trimmer, in which one blade of the trimming station trims the front edge of one printed product while two other blades simultaneously cut the top and bottom of another printed product. The printed products are supplied to the trimming station from a conveying belt that includes a number of dividers, against which the printed products are lined up. At the end of the conveying belt, the printed products are clamped and held in place between an upper and a lower belt before being supplied to a trimming transport device in the trimming station. In the trimming transport device, once the printed product has reached the predetermined position, the front edge of the product is trimmed by the first blade. The printed product is then transported further within the trimming transport device, where the top and bottom edges of the printed products are trimmed by the other two blades. In order to trim the desired position of the printed products, a mechanical stoppage device may be provided within the trimming transport device. However, in order to trim the desired position of the printed products more accurately, the trimming station may be provided with a measuring unit that controls the stoppage of the printed material before the trimming takes place. Using the measuring unit, it is possible to dispense with a mechanical stoppage device and hold the printed products in place between an upper belt and a lower belt within the trimming transport device for trimming. With a mechanical stoppage device, however, the printed products would have to be released before the desired stoppage point is reached.

It is often desirable to trim printed products with varying widths. For example, printed products intended for shipping, in particular by postal mail, may be produced with varying widths. This can be the result of the so-called "selective binding" on a gathering and wire-stitching apparatus. With digital printing presses, these products can be produced successively and such that the format differs from one printed product to another.

The conventional trimming apparatus discussed above can be used to trim printed products having different widths. To do so, however, a coupling of the drive must be disengaged, the apparatus shut down, and the operation interrupted. Therefore, changing the format of one or more printed products is not practical and cost-effective. Accordingly, it is advantageous to provide a trimming apparatus and a trimming method, which permit the trimming of successive printed products having varying widths at full operational speed without reducing output.

SUMMARY OF THE INVENTION

It is an object of the present invention to provide an apparatus and method for trimming printed products that would permit the trimming of successive printed products having varying widths at full operational speed without reducing output.

This and other objects are achieved by the invention, wherein, according to one embodiment, there is provided a method for automatic trimming printed products in a trimming apparatus having a trimming station including at least one blade positioned on a moveable yoke, wherein in one embodiment the method includes: supplying the printed products successively through a feeding conveyor to the trimming station, transporting each printed product within the trimming station via a trimming transport device to a predetermined position for trimming, and adjusting the phase position of the feeding conveyor relative to the moveable yoke for each printed product according to the format width of the printed product extending in a conveying direction.

According to another aspect of the invention, there is provided an apparatus for trimming the printed products, comprising: at least one trimming station including a yoke, at least one blade positioned on the yoke and a trimming transport device arranged to transport the plurality of printed products inside the at least one trimming station; a feeding conveyor arranged to feed the printed products to the trimming station; at least one driver coupled to and operative to drive the yoke, the feeding conveyor, and the trimming transport device, respectively; and a control unit coupled to the at least driver and operative to control the adjustment of the phase position of the feeding conveyor relative to the yoke.

According to an embodiment of the invention, the phase position of the feeding conveyor relative to the moveable yoke may be changed for any two successive printed products that have different format widths. According to a yet further embodiment of the invention, changing the phase position may depend on the format width of the printed product being fed from the feeding conveyor to the trimming station. According to the aforementioned embodiments of the invention, the phase position of the feeding conveyor relative to a yoke drive is adjusted to adapt the respective format width of the printed product that extends in conveying direction. This adaptation is realized by controlling the movement of the feeding conveyor, and the yoke.

In some embodiments, each printed product may be lined up in the conveying direction against a divider. In particular, the individual printed products may respectively come to rest with the bound edge pushed against a divider and the edge to the trimmer trailing. In some embodiments, the dividers may further be positioned with approximately uniform spacing on the feeding conveyor.

In some embodiments, the printed products may be guided within the trimming transport device on a circulating belt. According to another embodiment, the printed products may be held while clamped between an upper and a lower belt, so as to permit a precise guidance and a high trimming quality. In further embodiments, trimming transport device and the feeding conveyor may each include circulating upper and lower belts for guiding the printer products.

In some further embodiments of the invention, the position of each of the printed products in the trimming transport device may be measured, and if the position of the printed product differs from a desired predetermined position, the position of the printed product in the trimmer transport device may be corrected. Accordingly, the printed products may be trimmed with high precision. In other embodiments of the invention, however, an adjustment of the printed product to the desired position is possible even without the measuring unit. In such embodiments, the printed products can be held in place clamped-in between upper and lower belt and can be guided precisely to a desired position during the trimming operation. Therefore, the adjustment of the desired position and a virtual end stop as disclosed in EP 1 166 977 A1 is still possible.

According to a further embodiment, the trimming transport device and the yoke are advantageously driven by two separate motors, such as servomotors, which would permit an extremely quick change/conversion for successive printed products with different formats. The conversion may occur automatically during the operation, meaning the apparatus need not be shut down for a format change. Accordingly, it is possible to trim successively printed products having different formats, resulting from the so-called "selective binding."

In embodiments of the invention, the printed products may be respectively secured in the feeding conveyor until they are fully transported from the feeding conveyor to the trimming transport device. In such embodiments, the phase change begins as soon as the printed products are fully transported from the feeding conveyor and no printed products are located in the transfer region between the feeding conveyor and trimming transport device. In these embodiments, there is sufficient time for adjusting the phase position of the feeding conveyor relative to the yoke while trimming of the printed product currently positioned on the trimming transport device. Accordingly, it is possible to feed successive printed products having different format widths, e.g. in the range of 10-20 mm.

In embodiments of the invention, it is possible to change from a comparatively large product width to a considerably smaller product width for the following printed product and then again back to the comparatively large product width, without having to interrupt the transport.

In some embodiments, the printed products may be transferred from the feeding conveyor to the trimming transport device and guided by both conveyors during this transfer, wherein the two conveying devices are driven with synchronized speed at the time of transfer. The drivers for the feeding conveyor and preferably also the trimming transport device may be dynamic drives with corresponding motors, for example synchronous motors with rotational angle control.

In one embodiment of the invention, the trimming apparatus is embodied as a so-called three-knife trimmer.

Other embodiments, however, may be implemented in which the trimming apparatus executes only one cut, for example a frontal cut, or two cuts, or even more than three cuts.

BRIEF DESCRIPTION OF THE DRAWINGS

These and other features and advantages of the invention will be further understood from the following detailed description with reference to the accompanying drawings, which are depicted as follows.

DETAILED DESCRIPTION

Figure 1:
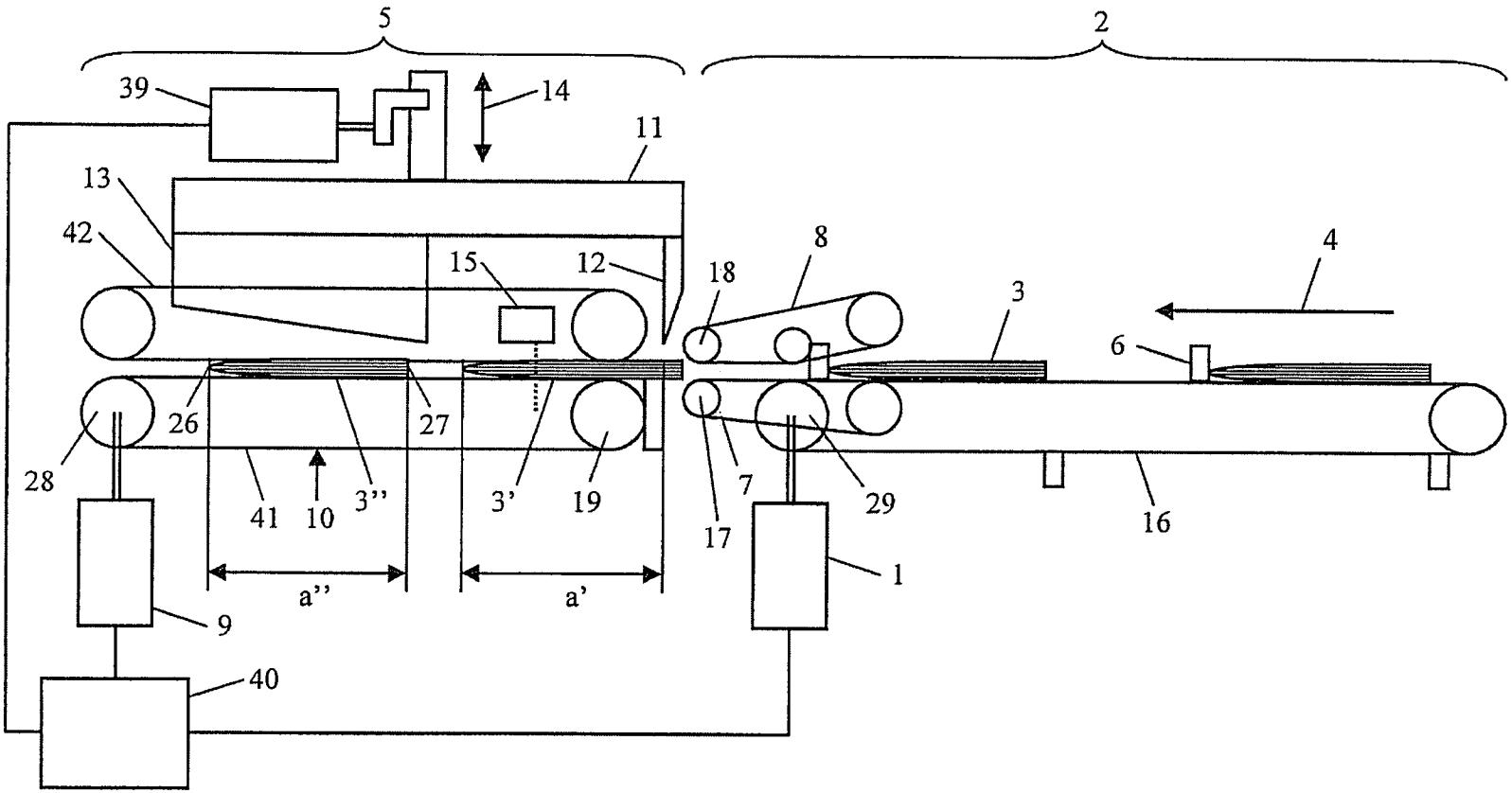
FIG. 1 is a schematic side view of a trimming apparatus according an embodiment to the invention.

The trimming apparatus shown in FIG. 1 is provided with a trimming station 5 to which printed products 3 are supplied successively from a feeding conveyor 2. These printed products 3 are conveyed on the feeding conveyor 2 in the direction of arrow 4 after arriving, for example, from a gathering and wire-stitching apparatus that is not shown herein. The printed products 3 may include brochures, magazines, catalogues, book blocks and the like. The printed products 3 have a bound leading edge 26 that extends in the conveying direction, as shown with arrow 4. The printed products 3 may, for example, be stitched along this bound edge 26. The printed products 3 may be conveyed on the conveyer belt 16 at a distance to each other, each being lined up against a divider 6.

The printed products 3 are transferred successively via a trimming transport device 10 within the trimming station 5. In this trimming station 5, the printed products 3 are trimmed on the front with a blade 12 and on the top and bottom with two blades 13 (only one blade shown). The trimming transport device 10 is used for positioning the printed products 3 to be trimmed and for transporting the products from a first location a' where the front is trimmed to a second location a" where the top and bottom are trimmed. FIG. 1 shows a printed product 3' in position a' for the frontal trimming and a printed product 3", whose front edge has already been trimmed, in position a" for the top and bottom trimming. The printed products 3, 3', and 3" can have different formats and different product widths. The formats and/or product widths and/or data relating thereto, which may be stored, for example, in a printing press that is not shown herein and/or a gathering and wire-stitching apparatus not shown herein, are available for the control of the trimming apparatus.

A driver 1 is used to drive and operate the feeding conveyor 2. The driver 1 is attached to a drive roller 29 around which a traction device is fitted, for example a chain or toothed belt. During the operation of the feeding conveyor belt 16, the dividers 6 are moved in the direction of arrow 4 towards the trimming station 5. In the region of the drive roller 29, the dividers 6 move around the drive roller 29 and thus away from the printed product 3, in a downward direction. At about the same time, the printed products 3 are each gripped by an upper belt 8 and a lower belt 7 and are conveyed further at the same speed and in the same direction of arrow 4. The printed products 3 are held in place and guided by the upper belt 8 and the lower belt 7, which are also operated by the driver 1. The driver 1 is a dynamic driver, which allows changing the speed of the feeding conveyor belt 16, as well as the speed of upper belt 8 and lower belt 7, at any time and on short notice. The lower belt 7 and the upper belt 8 may respectively consist of several partial belts, arranged side-by-side and at a distance to each other, so that the dividers 6 can move between these partial belts. The feeding conveyor belt 16 can also consists of several partial chains.

The trimming transport device 10 is provided with a separate, also dynamic driver 9 that comprises a motor as well as a control unit 40 in the form of a position transmitter. The conveyor is driven by a drive roller 28, arranged at a distance to a deflection roller 19. For the frontal trimming, the printed products 3 are positioned between a lower belt 41 and an upper belt 42 and are subsequently conveyed further down the trimming transport device for the top and bottom trimming. In FIG. 1, the printed product 3' is in position to be trimmed on its front edge by blade 12. The blade 12 is attached to a yoke 11. The front of printed product 3" has already been trimmed on the front edge 27 and the product in now in position for the top and bottom trimming. As seen in the conveying direction 4, the bound edge 26 is leading and the front edge 27 is trailing. The printed product 3" is positioned underneath the two blades 13, of which only the front blade is visible in FIG. 1. The two blades 13 are also attached to yoke 11, which is positioned on a machine frame that is not shown herein and can move vertically up and down with limitations, as shown with double arrow 14. The yoke 11 is moved with the aid of a third driver 39, which can be embodied as dynamic drive. The third driver 39 is connected to control unit 40, which in turn is connected to the driver 1 and the driver 9.

A measuring unit 15 for sensing the respective position of a printed product 3 is arranged near the trimming transport device, past the blade 12 in the conveying direction 4. The measuring unit 15 may include, for example, an optical sensor, and is not shown in further detail herein. The measuring unit 15 records the position of the front edge 27 and/or the bound edge 26 of an incoming printed product 3 and transmits this position to the control unit 40. Deviations from the desired position can subsequently be corrected by adjusting the trimming transport device 10, which is driven by the dynamic driver 9, which itself is controlled by the control unit 40. Accordingly, it is possible to precisely adjust the desired position shown in FIG. 1, even without a mechanical stoppage device. For further disclosure, please refer to the previously mentioned EP 1 166 977 A, the content of which is incorporated in its entirety herein by reference. The measuring unit 15 is not necessary, but does permits a higher trimming precision.

The feeding conveyor 2 transfers the individual printed products 3 to the trimming transport device 10. The printed products 3 leave the feeding conveyor 2 at the location of two deflection rollers 17 and 18, arranged one above the other, and are then gripped respectively at the bound edge 26 in the region of a deflection roller 19 with a corresponding upper deflection roller. During the feeding of the printed products 3 into the trimming station, the printed products are jointly gripped and guided during a specific interval by both the feeding conveyor 2 and the trimming transport device 10, during which the feeding device 2 and the trimming transport device 10 operate at a synchronized speed. Once the respective printed product 3 leaves the feeding conveyor 2, the speeds for the feeding conveyor 2 and the trimming transport device 10 can be controlled independently. Such control is possible in the arrangement depicted in FIG. 1, in which the printed product 3' has left the feeding conveyor 2 and is guided solely by the trimming transport device 10. The following printed product 3 is positioned completely in the region of the feeding conveyor 2. In this arrangement, the phase position of the printed product 3 relative to the yoke 11 can be changed, so as to achieve an adaptation to the format width of a printed product 3. As used herein, adjusting or changing the phase position of the feeding conveyor relative to the yoke, means that a point in the cyclical cutting operation of the yoke, for example lower dead center, is adjusted relative to the cyclical operation of the feed conveyor or vice versa, in order to adjust the sequence of movement of the cutting blades in the trimming operation. This may be achieved, for example, by adjusting the frequency of the cyclical operation of the yoke, or adjusting the cyclical speed of the feed conveyor, or both. The adjustment of the phase position is necessary when there is a change in format width so that the printed product with the new format width will be trimmed at the proper location. This operation is explained in further detail in the following with reference to FIGS. 2 and 3.

Figure 2:
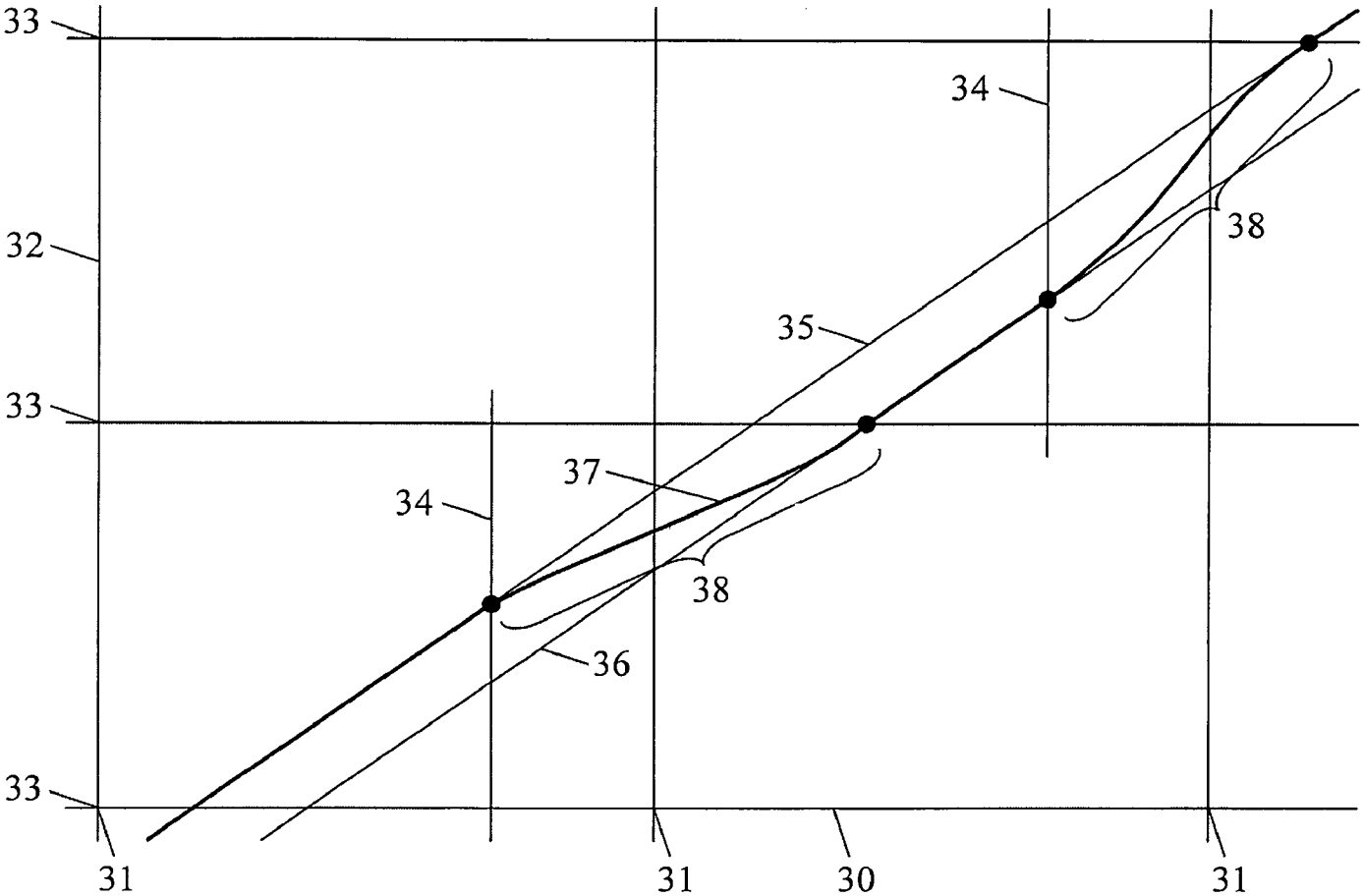
FIG. 2 illustrates the movement graphs for two different formats, wherein the horizontal axis indicates the position of the yoke and the vertical axis indicates the position of the feeding conveyor.

In the representation according to FIG. 2, the horizontal axis 30 corresponds to the position of the yoke drive 39. At points 31, the yoke 11 is always positioned in the lower dead center, in which the individual printed product 3 has already been trimmed and the knives 12 and 13 are again moved upward. The vertical axis 32 corresponds to the position of the drive 1 and thus the feed-in position. At points 33, the bound edge 26 of the printed product 3 is positioned at the start of the trimming transport device 10. Lines 34 indicate where the printed product 3 has been fully transported from the lower belt 7, the upper belt 8 of the feeding conveyor 2. The straight line 35 represents the transport of a printed product 3, having a large product or format width, whereas the line 36 represents the transport of a printed product 3 with a smaller product and format width.

The more emphasized line 37 represents the area of format change during a change-over from a printed product with large format width (line 35 of FIG. 2) to a printed product with small format width (line 36 of FIG. 2) and back again to a printed product with a large format width (line 35 of FIG. 2). In the two regions 38, no printed product 3 is located in the area of transfer from the feeding conveyor 2 to the trimming transport device 10. As can be seen, since the format widths of the successive printed products 3 are different, the phase position of the feeding conveyor 2 relative to the yoke 11 is changed in these regions 38. Between the two regions 38, however, a printed product 3 is gripped jointly by the feeding conveyor 2 and the trimming transport device 10. The two conveying devices move at the same speed in this area and, accordingly, there is no change in the phase position relative to the drive 39. A comparatively small time window is available for the adaptation to the format width. However, this time window is sufficient for effecting a format change of 20 mm, for example, while the production speed remains unchanged.

Figure 3:
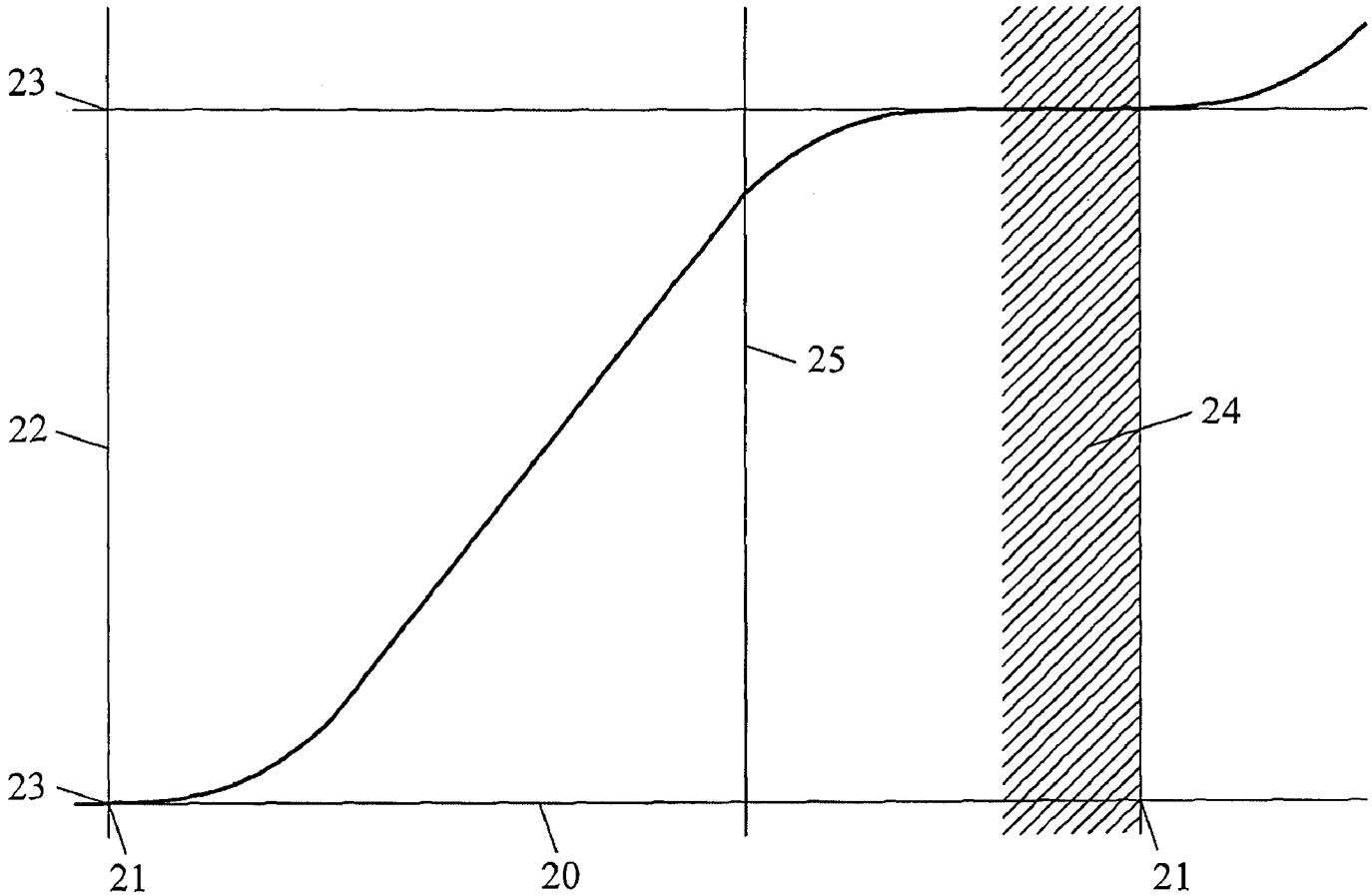
FIG. 3 illustrates a different movement curve, wherein the horizontal axis again indicates the position of the yoke and the vertical axis indicates the position of the trimming transport device.

In the representation according to FIG. 3, the horizontal axis 20 indicates the position of drive 39 on the yoke 11. Points 21 respectively indicate the position of the yoke 11 in the lower dead center. The vertical axis 22 corresponds to the position of the trimming transport device 10 and/or the drive 9. At points 23, a printed product 3' is in the idle position, meaning the correct position for trimming. The printed product 3' is trimmed in an area 24, shown herein with hatching. Line 25 marks the transition from a region in which a printed product 3 is gripped by the feeding conveyor 2 as well as the trimming transport device 10. The position of line 25 and/or the limiting area depends on the format width of the respective printed product 3. In this region, the feeding conveyor 2 operates at the same speed as the trimming transport device 10. Downstream of the line 25 shown in FIG. 3, the aforementioned printed product 3 has left the lower belt 7 and the upper belt 8. The phase position relative to the yoke 11 can thus be changed until the printed product 3 reaches the rest position and thus the desired position for trimming.

The invention consequently allows producing postal shipments that meet route requirements, i.e. the printed products are produced and packaged in the manner in which they are distributed later on by the postal service. Printed products with different formats, intended for the same addressee, can be produced successively on the same apparatus.

The invention has been described in detail with respect to various embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A method for automatic trimming a plurality of printed products in a trimming apparatus having at least one trimming station including at least one blade positioned on a moveable yoke, comprising steps of:

supplying the plurality of printed products successively and continuously through a feeding conveyor to the trimming station, wherein a leading print product of the plurality of printed products is first supplied through the feeding conveyor followed by a second print product of the plurality of printed products;

transporting each of the plurality of printed products within the trimming station via a trimming transport device to a predetermined position for trimming: wherein the trimming transport device has a velocity that matches a velocity of the feeding conveyor during a joint gripping of the respective printed products by the trimming transport device and the feeding conveyor;

driving the moveable yoke with a yoke drive separately from a drive for the feeding conveyor, the at least one blade moving vertically to trim each of the plurality of printed products; and adjusting the velocity of the feeding conveyor drive independently of the trimming transport device and the yoke drive for each of the plurality of printed products during a time window that begins when the leading printed product exits the feeding conveyor and ends when the trimming transport device grips the second printed product, wherein the adjusting is based on a format width of the printed product extending in a conveying direction and includes controlling the respective drives of the feeding conveyor and the moveable yoke.

2. The method of claim 1, wherein the adjusting step includes changing the velocity of the feeding conveyor drive relative to the yoke drive for at least two successive printed products having different format widths.

3. The method of claim 2, wherein the changing step includes controlling the velocity of the feeding conveyor drive in dependence of the format width of the printed product being fed from the feeding conveyor to the trimming station.

4. The method of claim 3, further comprising:

measuring a position of each of the plurality of printed products in the trimming transport device; and adjusting the position of the printed product in the trimming transport device if the position of the printed product differs from a predetermined position.

5. The method of claim 2, further comprising:

measuring a position of each of the plurality of printed products in the trimming transport device; and adjusting the position of the printed product in the trimming transport device if the position of the printed product differs from a predetermined position.

6. The method according to claim 1, wherein the adjusting includes controlling the drive of the feeding conveyor.

7. The method of claim 1, further comprising:

measuring a position of each of the plurality of printed products in the trimming transport device; and adjusting the position of the printed product in the trimming transport device if the position of the printed product differs from a predetermined position.

8. The method of claim 1, wherein the supplying step includes lining up each of the plurality of printed products in the conveying direction against a divider.

9. The method of claim 1, wherein the transporting step includes guiding the plurality of printed products within the trimming transport device on at least one circulating belt.

* * * * *